US007840318B2

(12) United States Patent
Bremsjö

(10) Patent No.: US 7,840,318 B2
(45) Date of Patent: Nov. 23, 2010

(54) BOAT AND CONTROL SYSTEM FOR A BOAT

(75) Inventor: Lars Bremsjö, Olofstorp (SE)

(73) Assignee: AB Volvo Penta, Gothenberg (SE)

( * ) Notice: Subject to any disclaimer, the term of this patent is extended or adjusted under 35 U.S.C. 154(b) by 0 days.

(21) Appl. No.: 11/553,371

(22) Filed: Oct. 26, 2006

(65) Prior Publication Data

US 2007/0049136 A1 Mar. 1, 2007

Related U.S. Application Data

(63) Continuation of application No. PCT/SE2004/000650, filed on Apr. 26, 2004.

(51) Int. Cl.
*G05D 1/08* (2006.01)

(52) U.S. Cl. ..... 701/21; 114/144 RE

(58) Field of Classification Search ..... 701/21
See application file for complete search history.

(56) References Cited

U.S. PATENT DOCUMENTS

| | | | | |
|---|---|---|---|---|
| 3,662,243 | A | 5/1972 | Cavil et al. | |
| 4,817,466 | A * | 4/1989 | Kawamura et al. | 477/112 |
| 5,351,776 | A | 10/1994 | Keller et al. | |
| 5,399,112 | A | 3/1995 | Bohlin et al. | |
| 5,741,166 | A * | 4/1998 | Newman | 440/84 |
| 6,021,369 | A * | 2/2000 | Kamihira et al. | 701/102 |
| 6,086,435 | A * | 7/2000 | Hoshiba et al. | 440/1 |
| 6,151,548 | A * | 11/2000 | Kamihira et al. | 701/102 |
| 6,199,650 | B1 * | 3/2001 | Masberg et al. | 180/197 |
| 6,278,986 | B1 * | 8/2001 | Kamihira et al. | 706/25 |
| 6,529,816 | B1 * | 3/2003 | Yamaguchi et al. | 701/110 |
| 6,622,074 | B1 * | 9/2003 | Coelingh et al. | 701/48 |
| 6,659,815 | B2 * | 12/2003 | Motsenbocker | 440/1 |
| 6,816,764 | B2 * | 11/2004 | Coelingh et al. | 701/37 |
| 6,855,020 | B2 * | 2/2005 | Kaji | 440/84 |
| 6,863,580 | B2 * | 3/2005 | Okuyama | 440/1 |
| 6,868,317 | B2 * | 3/2005 | Okuyama | 701/21 |
| 6,884,128 | B2 * | 4/2005 | Okuyama et al. | 440/1 |
| 7,166,003 | B2 * | 1/2007 | Motose | 440/1 |
| 7,207,856 | B2 * | 4/2007 | Ishida et al. | 440/87 |
| 2002/0016659 | A1 * | 2/2002 | Tashiro et al. | 701/48 |
| 2002/0068490 | A1 * | 6/2002 | Ochiai | 440/89 |

(Continued)

FOREIGN PATENT DOCUMENTS

| | | | |
|---|---|---|---|
| EP | 1279586 | A2 | 1/2003 |

(Continued)

*Primary Examiner*—Thomas G Black
*Assistant Examiner*—Shelley Chen
(74) *Attorney, Agent, or Firm*—Michael Pruden; Martin Farrell

(57) ABSTRACT

A control system for a boat including a first hierarchical control module which receives command signals from sensors connected to a throttle control member to emit a command signal corresponding to the required acceleration and sensors connected to a steering control device to emit a command signal corresponding to the required direction of travel. A second hierarchical control module is arranged to execute operating routines for power units including at least a propulsion motor and a servo device for a direction of travel setting device, where the operating routines generate operating signals for the power units in response to input data in the form of externally received target value signals generated by a third hierarchical control module in response to operating conditions of the boat, and a boat having such a control system.

7 Claims, 3 Drawing Sheets

U.S. PATENT DOCUMENTS

| | | | | |
|---|---|---|---|---|
| 2003/0019414 | A1 | 1/2003 | Borrett | |
| 2003/0060094 | A1* | 3/2003 | Motsenbocker | 440/6 |
| 2003/0150366 | A1 | 8/2003 | Kaufmann et al. | |
| 2003/0225494 | A1* | 12/2003 | Coelingh et al. | 701/48 |
| 2003/0225495 | A1* | 12/2003 | Coelingh et al. | 701/48 |
| 2003/0225496 | A1* | 12/2003 | Coelingh et al. | 701/48 |
| 2004/0044443 | A1* | 3/2004 | Eriksson | 701/1 |
| 2004/0090195 | A1* | 5/2004 | Motsenbocker | 318/109 |
| 2004/0121661 | A1* | 6/2004 | Okuyama | 440/1 |
| 2004/0181322 | A1* | 9/2004 | Okuyama | 701/21 |
| 2004/0242091 | A1* | 12/2004 | Okuyama et al. | 440/86 |
| 2005/0085141 | A1* | 4/2005 | Motose | 440/87 |
| 2005/0171669 | A1* | 8/2005 | Sato | 701/51 |
| 2005/0240319 | A1* | 10/2005 | Sawada | 701/1 |
| 2006/0111825 | A1* | 5/2006 | Okada et al. | 701/48 |
| 2007/0049136 | A1* | 3/2007 | Bremsjo | 440/1 |
| 2007/0083315 | A1* | 4/2007 | Takamatsu et al. | 701/90 |
| 2007/0142987 | A1* | 6/2007 | Takamatsu et al. | 701/41 |
| 2007/0150118 | A1* | 6/2007 | Takamatsu et al. | 701/1 |

FOREIGN PATENT DOCUMENTS

| | | | |
|---|---|---|---|
| SE | 508314 | C2 | 9/1998 |
| WO | 9901320 | A1 | 1/1999 |
| WO | 03059680 | A1 | 7/2003 |

* cited by examiner

BOAT AND CONTROL SYSTEM FOR A BOAT

CROSS-REFERENCE TO RELATED APPLICATIONS

The present application is a continuation patent application of International Application No. PCT/SE2004/000650 filed 26 Apr. 2004 which is published in English pursuant to Article 21(2) of the Patent Cooperation Treaty. Said application is expressly incorporated herein by reference in its entirety.

FIELD

The present invention relates to a control system for a boat as claimed in the preamble to claim 1. In particular, it relates to a control system for a boat comprising a propulsion motor and a direction of travel setting device, for example in the form of a rudder, adjustable drive or waterjet unit that can be directed, in which the control of the propulsion motor and the direction of travel setting device is carried out electronically.

In addition, the present invention relates to a boat comprising a control system for a first and a second driveline, each of which comprises a propulsion motor and a servo device for a direction of travel setting device. The control system comprises command-level components including sensors connected to the throttle(s) for emitting a command signal or signals corresponding to the required (i.e., commanded) acceleration of the boat and sensors connected to a control device for emitting a command signal corresponding to the required direction of travel of the boat. The control system further comprises a first hierarchical control module, which receives and processes the throttle and control device command signals and generates control signals based on those command signals. The control system further comprises a second hierarchical control module arranged for each driveline, which second hierarchical control module is arranged to execute operating routines for power units comprising at least a propulsion motor and a servo device for a direction of travel setting device, where the operating routines generate operating signals for the power units in response to input data in the form of target value signals generated externally to the second hierarchical control module.

BACKGROUND

With conventional steering of boats with controllable propeller drives, a mechanical power transmission or mechanical power transmission connected to a hydraulic system is used for power amplification from a wheel to the propeller drive, an example of such a system being given in U.S. Pat. No. 5,399,112. This type of steering is well-suited for boats equipped with one drive, and for boats where the distance between the wheel and actuator for the controllable propeller drive is not such that the laying of cables between the wheel and actuator constitutes a problem.

For boats equipped with several drives and for boats where it is not desirable to have mechanical or hydraulic power transmission from the position where the wheel is located to actuators for setting the position of the propeller drives, it is expedient to utilize electronic control of the actuators. This applies in particular for a type of boat which is driven at planing speeds and is designed with a V-bottomed hull designed for planing, with an individually-controllable drive suspended on each side of the center line of the hull. These drives comprise an underwater housing projecting downwards from the outside of the hull, suspended in such way that it can be rotated in relation to the hull. A drive shaft is mounted in the underwater housing in such a way that it can rotate. The drive shaft drives a propeller shaft that is at least essentially horizontal, via a bevel gear mechanism contained in the underwater housing. Such a type of boat is known in, for example, SE-9402272-0. As the drives are suspended at right angles to the bottom of the hull on each side of the center line of the V-shaped hull, the drive shafts will be angled in relation to each other. This means that a mechanical power transmission for steering both drives would be very complex, in particular in the case when individual steering of the drives is required in response to movements of the wheel.

To achieve the abovementioned object, it is advantageous to utilize electronic control of steering for a propeller drive on a boat comprising a propeller drive suspended in a housing that can be rotated. In other types of boat, as well as in speedboats with planing V-bottomed hulls, it can be advantageous to utilize an electronic control system for the boat. This applies in particular when the boat comprises a plurality of power units in the form of propulsion motors and servo motors for direction setting devices, all of which are to be controlled by the helmsman and where it is desirable for the boat to be able to be driven in a plurality of modes, with the response from the throttle and wheel depending upon the mode in which the boat is being driven.

In order to ensure that the driving characteristics of the boat are retained when the degree of complexity of the boat increases, for example by several drives being utilized or by the boat being able to be controlled in a number of modes, support functions are required for the helmsman, for example in the form of mode selections for docking, operation at planing speeds, operation below planing speeds, acceleration characteristics, turning characteristics or operation in failsafe mode.

SUMMARY

The present invention is intended to provide a control system for a boat, which allows support functions to be implemented in a structured way so that the control system can easily be adapted to individual characteristics of the boat in which the control system is utilized.

The invention utilizes an electronic control system for boats, comprising a first hierarchical control module which receives and processes command signals from sensors connected to, for example, the throttle to emit a command signal corresponding to the required (i.e., commanded) acceleration of the boat and a control device for emitting a command signal corresponding to the required (i.e., commanded) direction of travel of the boat. The control device can, for example, be internal and in the form of, for example, a wheel or a joystick, or can be external and in the form of, for example, an autopilot or a navigation system.

In addition, the control unit comprises a second hierarchical control module which is arranged to execute operating routines for power units comprising, for example, a propulsion motor and a servo motor for a direction setting device, where the operating routines generate operating signals for the power units in response to input data in the form of externally received target value signals. The second hierarchical control module comprises conventional control units for the respective power units. These control units control the respective power units in response to externally received target value signals, for example in the form of required acceleration or required direction of travel. This is in contrast to a conventional design of a control system, in which the second hierarchical control module is connected directly to sensors arranged on the throttle and wheel and in which monitoring of the boat's power units is then carried out directly by the helmsman.

As claimed in the invention, the control system comprises a third hierarchical control module in which control signals output by the first hierarchical control module, which control signals are based on the command signals from the command-level components, are converted to the target value signals, in response to conditions corresponding to the current driving characteristics of a boat, that are input into the second hierarchical control module.

The current driving characteristics can consist of information about which operating mode the boat is being driven in, which for example can consist of docking, operation at planing speeds, operation at speeds lower than planing speeds or operation in failsafe mode. In addition, the current driving characteristics can comprise information about the function of power units that are controlled by the third hierarchical control module and information about the function of power units that are not controlled by the third hierarchical control module. In addition, the current driving characteristics can comprise information about the boat's characteristics, such as speed at which the boat is being driven, wind conditions, wave conditions, etc.

Finally, the current driving characteristics can comprise boat-specific information such as required acceleration characteristics, speed restrictions, turning characteristics, etc.

By converting in the third hierarchical control module the control signals output by the first hierarchical control module (which are based on the command signals from the boat's control devices in the form of wheel or throttle) into target value signals which are dependent upon conditions corresponding to current driving characteristics of the boat, a control system is obtained which supports operation of the boat in a plurality of different operating modes, where a given input signal from the sensors to the first hierarchical control module generates different target value signals depending upon which mode has been selected at the time.

In addition, adaptation of the control system to different types of boats equipped with different types of power units is made easier by separating the boat's driving characteristics into a control module that is separated from the control units that control the boat's power units. In this way, the control units for the power units can be adapted to control the respective power units in a way that is adapted for each power unit, while input data in the form of external target value signals for the control units is adapted in the third hierarchical control module to the required behavior of the boat by converting command signals from the boat's command-level control devices into target value signals depending upon conditions corresponding to the current driving characteristics of a boat.

The invention also relates to a boat comprising a control system for a first and a second driveline, each of which comprises a propulsion motor and a servo motor for a direction of travel setting device. The control system comprises command-level components including sensors connected to the throttle(s) for emitting a command signal or signals corresponding to the required (i.e., commanded) acceleration of the boat and sensors connected to a control device for emitting a command signal corresponding to the required (i.e., commanded) direction of travel of the boat. The control system further comprises a first hierarchical control module, which receives and processes the throttle and control device command signals and generates control signals based on those command signals. The control system further comprises, in addition, a second hierarchical control module arranged for each driveline, which second hierarchical control module is arranged to execute operating routines for power units comprising at least a propulsion motor and a servo motor for a direction of travel setting device. The operating routines in the second hierarchical control module generate operating signals for the power units in response to input data in the form of externally received target value signals. The control system comprises, in addition, a third hierarchical control module arranged for each driveline, in which the control signals generated by the first hierarchical control module are converted into those target value signals in response to conditions corresponding to the current driving characteristics of a boat.

As each driveline is equipped with its own third hierarchical control module, it is ensured that the drivelines can be driven independently of each other. A fault in the control of one driveline will not then automatically give rise to a fault in the other driveline. However, as claimed in an embodiment of the invention, the status of the second driveline can result in the third hierarchical control module in the first driveline controlling its own power units taking into account the status of the second driveline. However, the third hierarchical control module controls its allocated driveline independently. By this is meant that even though the status of the second driveline can affect control instructions that are generated by the third hierarchical control module belonging to the first driveline, this effect takes place only through input data in control routines that are executed by the third hierarchical control module belonging to the first driveline. In a corresponding way, it is the case that the status of the first driveline can affect control instructions that are generated by the third hierarchical control module belonging to the second driveline, this effect taking place only through input data in control routines that are executed by the third hierarchical control module belonging to the second driveline. The third hierarchical control module in both the drives has knowledge of all the defined state variables for the boat characteristics. The system therefore has 100% redundancy. For example, both third hierarchical control modules have knowledge of the function/status of both the boat's drivelines. This means that if only one driveline is active, the active third hierarchical control module acts as if it is controlling a boat that comprises only one driveline. This is carried out irrespective of which driveline is active. In the case when both the drivelines are active, both the third hierarchical control modules act as if they were controlling a boat that comprises two drivelines.

In addition to input signals from the first hierarchical control module and input signals from the drivelines' second hierarchical control modules, the third hierarchical control modules may receive and utilize signals from external sensors measuring boat characteristics.

BRIEF DESCRIPTION OF THE DRAWINGS

The invention will be described in greater detail with reference to the attached drawings, in which.

DETAILED DESCRIPTION

Figure 1:
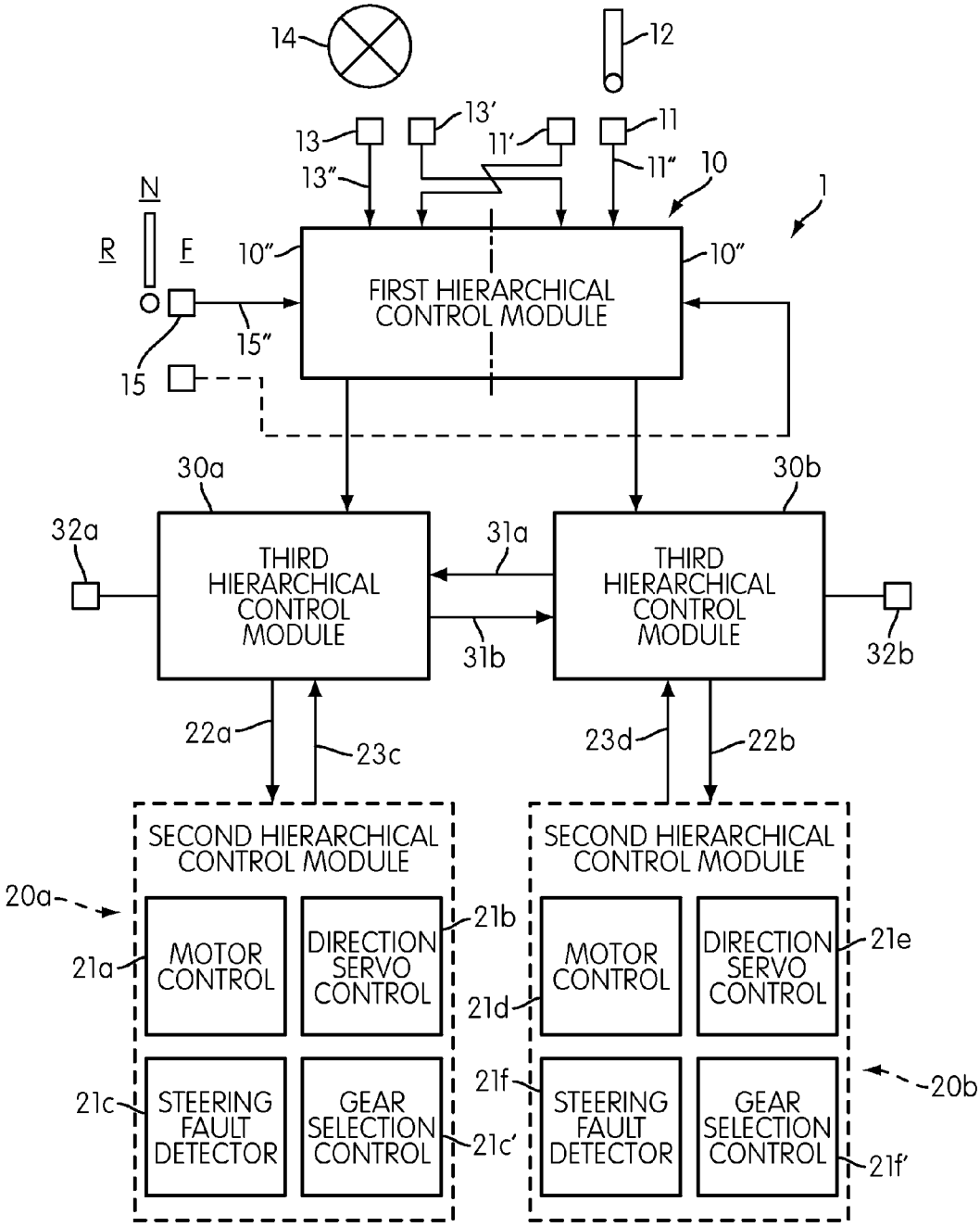
FIG. 1 shows a block diagram for a control system as claimed in the invention.

FIG. 1 shows a block diagram for a control system 1 as claimed in the invention. The control system includes command-level components including sensors 11 connected to a throttle 12 for emitting a command signal 11" corresponding to the acceleration required (i.e., commanded) by the operator and sensors 13 connected to a control device 14 for emitting a control signal corresponding to the direction of travel required (i.e., commanded) by the operator. The control device 14 can, for example, be designed as a conventional wheel or joystick or as both a wheel and a joystick. The command-level components further include a gear selector 16 and an associated sensor 15, which generates a command signal 15" corresponding to the gear position selected (i.e., commanded) by the operator. First hierarchical control module 10 receives and processes the throttle and control device command signals 11" and 13". First hierarchical control module also receives and processes gear control signal 15". The first hierarchical control module 10 outputs control signals based on the received and processed command signals 11", 13", and 15". As claimed in a preferred embodiment, there is a hierarchical control module of each rank (first, second, third) for each driveline. In this case, the first hierarchical control module is divided into two sections 10' and 10". This means that there is a wheel sensor 13, 13' for each driveline allocated to a shared wheel. In addition, there is a sensor 11, 11' for detecting the commanded acceleration for each driveline. These sensors can be attached to a common throttle, or alternatively each sensor can be connected to a separate throttle. The drivelines are preferably configured such that the respective hierarchical control modules (first, second, third) are identical in the first and the second drivelines (or on all the drivelines in the event that there are more than two drivelines on the boat).

The control system 1 comprises, in addition, a second hierarchical control module 20*a*, 20*b*. In the embodiment shown, there are two second hierarchical control modules. The first second hierarchical control module 20*a* comprises control units 21*a*-21*c* belonging to power units which are comprised in a first driveline arranged in a boat in which the control system is arranged. The second hierarchical control module 20*b* comprises control units 21*d*-21*f* belonging to power units that are comprised in a second driveline arranged in a boat in which the control system is arranged.

The second hierarchical control module 20*a*, 20*b* is arranged to execute operating routines for the power units comprised in the first and the second driveline. For this purpose, the second hierarchical control module 20*a*, 20*b* comprises control units which are adapted to control the respective power units. The power units comprise at least one propulsion motor comprised in each driveline and a servo device for a direction of travel setting device. The control units 21*a* and 21*d* for the propulsion motor consist of conventional motor control units, which can comprise an external control parameter corresponding to the required acceleration, in addition to a set of internal control parameters, which, in the event that the propulsion motor consists of a combustion engine, can comprise engine temperature, engine speed, fuel injection timing, etc. The control unit 21*b* and 21*e* for the servo device for a direction of travel setting device, that is for example a servo motor for a rudder or drive that can be rotated, consists of any type of well known regulator, which controls the servo device in response to a signal from a sensor 13 connected to the wheel 14 which detects the required direction of travel. In the operating routines that are executed in the control units 21*a*-21*f* comprised in the second hierarchical control module, operating signals are generated for the power units, in response to input data in the form of externally received target value signals 22*a*, 22*b*. The control units 21*c'* and 21*f* consist of control units for a gear selecting device 34*a*, 34*b*.

The control system 1 comprises, in addition, a third hierarchical control module. In the embodiment shown, there are two third hierarchical control modules 30*a*, 30*b*. The first third hierarchical control module 30*a* monitors the second hierarchical control module 20*a* in a first driveline. The third hierarchical control module 30*a* monitors the power units comprised in the second hierarchical control module 20*a* by selecting from control signals generated in the first hierarchical control module and converting these control signals into target value signals for the control units 21*a*-21*c* on the basis of the current boat characteristics, which specify the criteria for acceptable target value signals. These criteria can depend upon the state of the power units in the first driveline, which state is inquired about by the third hierarchical control module 30*a* and is supplied by the respective control unit 21*a*-21*c* as an input signal 23*c* to the third hierarchical control module 30*a*. In addition, the criteria can depend upon the state of the power units of the second driveline, which state is inquired about by the third hierarchical control module 30*a* and is supplied by the third hierarchical control module 30*b* belonging to the second driveline as an input signal 31*a* to the third hierarchical control module 30*a*. The third hierarchical control module 30*a* belonging to the first driveline thus only controls the power units belonging to the first driveline. However, information concerning the status of the power units in the second driveline can affect the control through the input signal 31*a*, where appropriate.

Finally, the criteria can also depend on signals received from external sensors 32*a* measuring characteristics of the boat such as, for example, the boat's speed.

In corresponding way, the second third hierarchical control module 30*b* monitors the second hierarchical control module 20*b* in a second driveline. The third hierarchical control module 30*b* monitors the power units comprised in the second hierarchical control module 20*b* by selecting from control signals generated in the first hierarchical control units and converting these control signals to target value signals for the control units 21*d*-21*f* in response to the current boat characteristics, which specify the criteria for acceptable target value signals. These criteria can depend on the state of the power units in the second driveline, which state is inquired about by the third hierarchical control module 30*b* and supplied by the respective control unit 21*d*-21*f* as an input signal 23*d* to the third hierarchical control module 30*b*. In addition, the criteria can depend on the state of the power units of first driveline, which state is inquired about by the third hierarchical control module 30*b* and supplied by the third hierarchical control module 30*a* belonging to the first driveline as an input signal 31*b* to the third hierarchical control module 30*b*. The third hierarchical control module 30*b* belonging to the second driveline thus only controls the power units belonging to the second driveline. However, information concerning the status of the power units in the first driveline can affect the control through the input signal 31*b*, where appropriate.

Finally, the criteria can also depend on signals received from external sensors 32*b* measuring characteristics of the boat such as, for example, the boat's speed.

Figure 2:
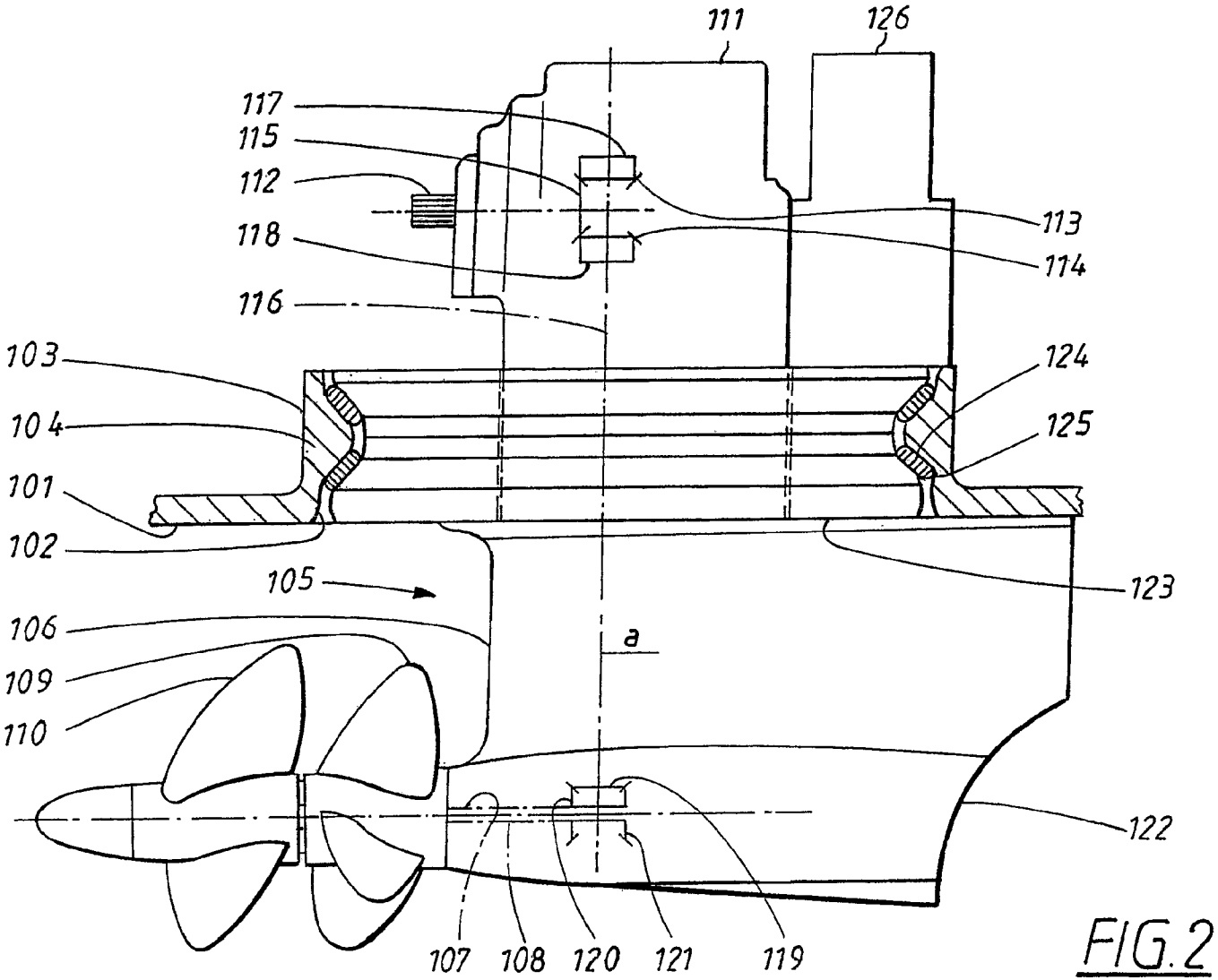
FIG. 2 shows a longitudinal section through a part of a boat bottom equipped with a drive of a type with which the invention can be utilized.
Figure 3:
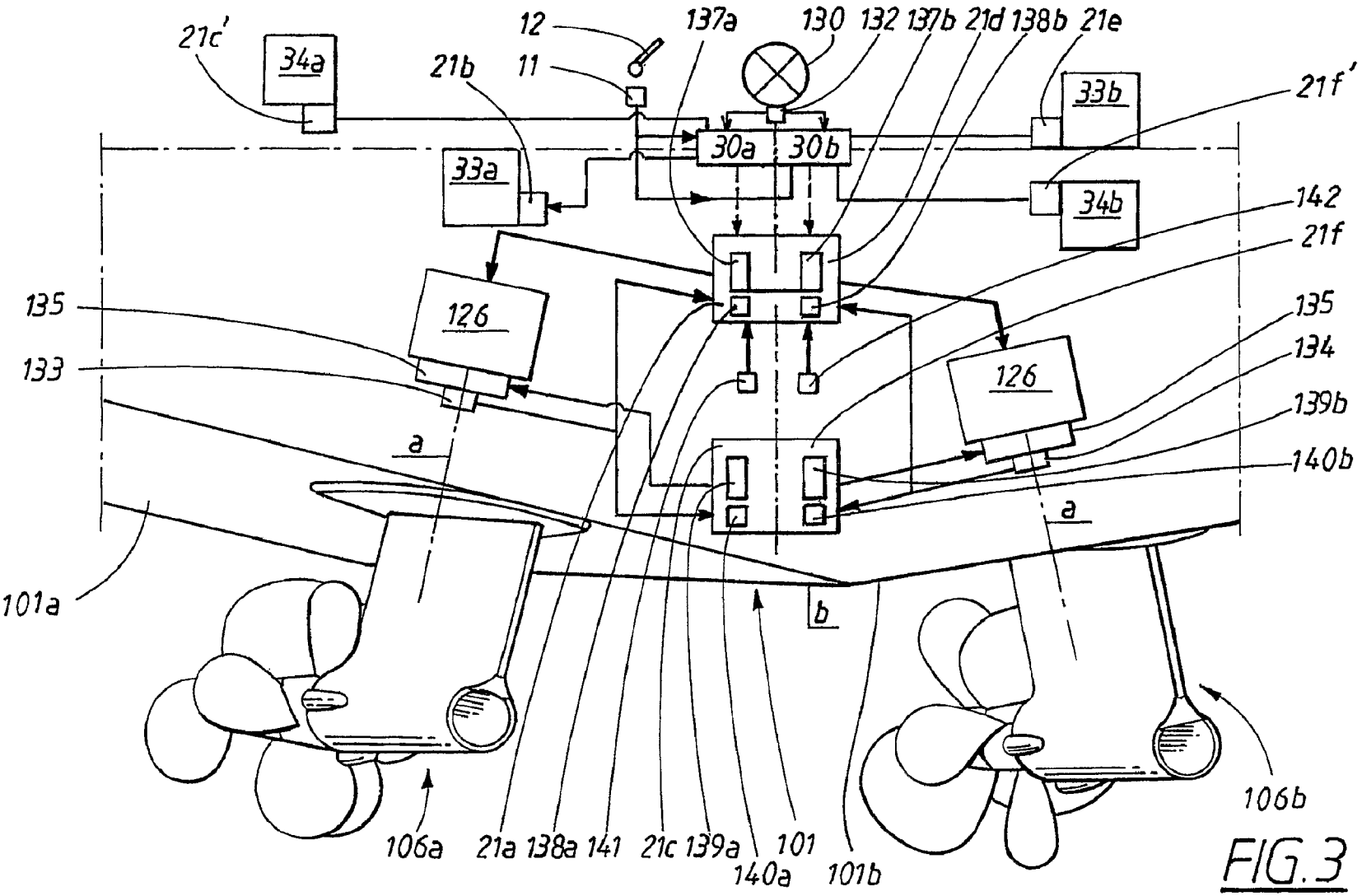
FIG. 3 shows a schematic illustration of the aft section of a boat with two drives of a type with which the invention can be utilized.

FIGS. 2 and 3 show an example of a boat which utilizes a control system of the type described above.

In FIG. 2, the bottom of a boat's hull, designated 101, can consist of molded glass fiber reinforced polyester plastic. The bottom of the hull is designed with an opening 102, which is surrounded by a vertical sleeve 103, which projects up into the interior of the hull. The sleeve is preferably molded in one piece with the bottom 101 and is designed with an internal peripheral flange 104 which, in the embodiment shown, has an essentially triangular cross section.

The sleeve 103 with the flange 104 forms a suspension device for a propeller drive designated in general by 105 which, in the embodiment shown, has an underwater housing 106, in which two concentric propeller shafts 107 and 108, each with a propeller 109 and 110, are mounted in such a way that they can rotate. The underwater housing 106 is connected to a gearbox 111, in which a horizontal drive shaft 112 is mounted in such a way that it can rotate. The shaft 112 is designed to be connected to an outgoing shaft from a motor (not shown). The shaft 112 drives a vertical shaft 116 via a bevel gear enclosed in the gear box 111, which bevel gear comprises conical cog wheels 113, 114 and 115. The cog wheels 113 and 114 are mounted on the shaft 116 in such a way that they can rotate or alternatively can be locked on the shaft by means of a multidisc lubricated disc clutch 117 and 118 respectively to drive the shaft 116 in either rotational direction. The shaft 116 drives the propeller shafts 107 and 108 in opposite rotational directions via a bevel gear enclosed in the underwater housing 106 and comprising cog wheels 119, 120 and 121. In the embodiment shown, the propellers 109 and 110 are tractor propellers arranged in front of the underwater housing 106, at the rear end of which there is an outlet 122 for exhaust gases.

The drive 105 is suspended in the opening 102 by means of a suspension element designated in general by 103, which engages around the flange 104 with interlayers consisting of a pair of vibration-suppressing and sealing flexible rings 124 and 125. The underwater housing 106 is mounted in the suspension element 123 in a way that is not described in greater detail so that it rotates around an axis of rotation "a" coinciding with the drive shaft 116. The rotation of the underwater housing 106 is achieved by means of a servo motor 126 that can be an electric motor with a cog wheel fixed on a shaft engaging with a gear ring connected to the underwater housing.

FIG. 3 shows the aft section of the hull of a boat with a V-shaped bottom 101. In each bottom section 101*a* and 101*b* respectively and at an equal distance from the center line "b" of the bottom, drives are suspended with underwater housings 106*a* and 106*b* of the type shown in FIG. 2. The underwater housings 106*a* and 106*b* can be suspended in the way that is illustrated in FIG. 2. In FIG. 3, a control device in the form of, for example, a wheel or a joystick at the helmsman's position is indicated by 130. The control device causes command signals to be generated and sent to a first hierarchical control module in accordance with what has been described above. The control device has a sensor for each driveline, which generates and supplies a command signal to a first hierarchical control module 30*a*, 30*b* arranged for each driveline. In addition, a throttle 12 causes a command signal to be generated and sent to the respective first hierarchical control module 30*a*, 30*b* via a sensor arranged for each driveline as described above. The respective third hierarchical control module generates target value signals for an electronic control unit 21*a*, 21*d* for a servo motor 126 which controls the setting of the adjustable drive in the respective driveline. By means of the respective servo motors 126, the drives' underwater housings can be rotated independently of each other around their axes of rotation "a" in response to signals from the control units 21*a*, 21*b* for steering the boat.

In addition, the respective third hierarchical control module generates target value signals for an electronic control unit 21*b*, 21*e* for a control unit 21*b*, 21*e* for a propulsion motor 33*a*, 33*b* belonging to the respective driveline.

The wheel 130 is linked with a sensor 132 which sends a signal to the control units 21*a*, 21*d* in response to movement of the wheel. The control units 21*a*, 21*d* each comprise a first microcomputer which is arranged to execute a control program for the servo motor 126. The microcomputer comprises at least a processor 137*a*, 137*b* and a memory 138*a*, 138*b*. In addition, there are position sensors 133 and 134 arranged to detect the angle of rotation of the underwater housings 106*a* and 106*b* around the axes of rotation "a". The position sensors 133 and 134 communicate with the control units 21*a*, 21*d*.

In addition, a safety brake 135 controlled by the control unit is arranged in association with each servo motor 126. The safety brake is arranged to lock the rotating housing so that it cannot rotate. This can be achieved, for example, by a brake yoke in the brake being brought into engagement with an extension of the rotating underwater housing 106*a*, 106*b* or by a brake yoke in the brake being brought into engagement with the motor or with parts of the transmission between the motor and the rotating housing. The safety brake is preferably designed in such a way that the brake is brought into engagement when an actuator in the brake is inactive. This can be achieved by a spring bringing the brake into engagement and by an actuator releasing the load on the brake when the housing is to be released in order that it can rotate. The actuator can be in the form of a solenoid or alternatively in the form of a pneumatic or hydraulic piston.

For the activation of the safety brake 135 and for the detection of a fault in the steering of the propeller drive, the arrangement comprises a monitoring device 21*c*, 21*f* belonging to each driveline. The monitoring devices 21*c*, 21*f* comprise a second microcomputer which is arranged to execute a monitoring program in order to ascertain whether there is a fault in the control of the propeller drive and to apply the safety brake in the event of the detection of a fault in the steering of the propeller drive. The microcomputer comprises a processor 139 and a memory 140. The first microcomputer, which is comprised in the control unit, and the second microcomputer, which is comprised in the monitoring unit, consist preferably of two separate units each with separate microprocessors. As claimed in an alternative embodiment, it is possible to design the monitoring unit as a simpler piece of hardware which monitors the function of the control unit.

The monitoring devices 21*c*, 21*f* are connected to the position sensors 133, 134 from which input signals are generated corresponding to the current position of the rotating housings. The monitoring devices 21*c*, 21*f* are connected, in addition, to the control device's sensor 132, the input signals from which specify a required position.

The second hierarchical control module comprises the control units 21*a*-21*f* which can be designed in the form of conventional microcomputers with separate processors and memories.

The invention is not restricted to the embodiments described above, but can be varied freely within the framework of the following patent claims. For example, there can be more than two drivelines on the boat.

In addition, the first hierarchical control module can comprise sensors for detecting a required gear position and the second hierarchical control module can comprise a power unit, which carries out gear selection on the basis of commands from the sensor comprised in the first hierarchical control module. In this case, the third hierarchical control module also monitors the gear selection, in the same way as for movements of the wheel and for acceleration.

What is claimed is:

1. A boat, comprising:

A first and a second driveline, each of which comprises a propulsion unit and a servo device for a direction-of-travel-setting device;

a control system for the boat, wherein the control system comprises:

command-level components comprising at least one throttle-control member by means of which an operator of the boat controls the boat's speed or acceleration; a sensor or sensors associated with the throttle-control member so as to sense the operator-set configuration thereof and generate speed or acceleration command signals indicative of the commanded speed or acceleration of the boat; a steering-control member by means of which the operator of the boat controls the boat's direction of travel; and a sensor or sensors associated with the steering-control member so as to sense the operator-set configuration thereof and generate steering command signals indicative of the commanded direction of travel of the boat;

a first hierarchical control module;

a second hierarchical control module associated with each of the drivelines;

a third hierarchical control module associated with each of the drivelines;

wherein the first hierarchical control module receives and processes the speed or acceleration command signals and the steering command signals and generates and outputs speed or acceleration control signals and steering control signals corresponding to the speed or acceleration command signals and the steering command signals, respectively;

wherein the second hierarchical control module associated with each driveline is configured to execute operating routines for the propulsion unit of the driveline, which operating routines generate operating signals for the propulsion unit of the driveline in response to target value signals generated externally to said second hierarchical control module associated with the driveline; and wherein the third hierarchical control module associated with each driveline receives and processes the speed or acceleration control signals and the steering control signals output by the first hierarchical control module and, in response to conditions corresponding to driving characteristics of the boat, converts those speed or acceleration control signals and steering control signals into said target value signals for the driveline with which the third hierarchical control module is associated.

2. The boat as claimed in claim 1, wherein the third hierarchical control module associated with each of the drivelines is configured to generate the target value signals for the propulsion unit of the driveline with which it is associated on the basis of at least the speed or acceleration control signals and the steering control signals and in response to the status of the propulsion unit of the other driveline.

3. The boat as claimed in claim 2, wherein the third hierarchical control module associated with each of the drivelines is configured to generate the target value signals for the propulsion unit of the driveline with which it is associated in response to a status report emitted by the third hierarchical control module associated with the other driveline.

4. The boat as claimed in claim 2, wherein the third hierarchical control modules are arranged to generate the target value signals on the basis of driving characteristics of the boat as measured by one or more sensors.

5. The boat as claimed in claim 1, wherein the third hierarchical control module associated with each driveline has the same priority as the third hierarchical control module associated with the other driveline and independently controls the driveline with which it is associated while taking into account internal and external signals.

6. The boat as claimed in claim 1, wherein the control system is configured such that the status of the second driveline can affect control instructions that are generated by the third hierarchical control module associated with the first driveline, this effect taking place only through input data in control routines that are executed by the third hierarchical control module associated with the first driveline, and vice-versa.

7. The boat as claimed in claim 1, wherein said command-level components further comprise a gear selector and an associated sensor which is configured to sense the configuration of the gear selector and to emit a command signal corresponding to a commanded gear position; wherein said first hierarchical control module receives and processes said gear command signal and outputs a gear control signal based thereon; and wherein said third hierarchical control module or modules processes/process the gear control signal output by the first hierarchical control module and converts/convert it into a further target value signal, which is output to said second hierarchical control module or modules, in response to conditions corresponding to the current driving characteristics of the boat.

* * * * *